US011408609B2

(12) United States Patent
Prociw et al.

(10) Patent No.: US 11,408,609 B2
(45) Date of Patent: Aug. 9, 2022

(54) COMBUSTOR DOME TILES

(71) Applicant: Delavan Inc., West Des Moines, IA (US)

(72) Inventors: Lev Alexander Prociw, Johnston, IA (US); Jason A. Ryon, Carlisle, IA (US); Gregory A. Zink, Des Moines, IA (US)

(73) Assignee: Collins Engine Nozzles, Inc., West Des Moines, IA (US)

( * ) Notice: Subject to any disclaimer, the term of this patent is extended or adjusted under 35 U.S.C. 154(b) by 261 days.

(21) Appl. No.: 16/171,941

(22) Filed: Oct. 26, 2018

(65) Prior Publication Data

US 2020/0132303 A1 Apr. 30, 2020

(51) Int. Cl.
*F23R 3/00* (2006.01)
*F23R 3/50* (2006.01)

(52) U.S. Cl.
CPC ..... *F23R 3/002* (2013.01); *F23R 3/50* (2013.01); *F05D 2240/35* (2013.01); *F05D 2300/6033* (2013.01)

(58) Field of Classification Search
CPC ..... F02C 7/222; F05D 2230/6033; F05D 2240/35; F23R 3/002; F23R 3/007; F23R 3/02; F23R 3/04; F23R 3/10; F23R 3/28; F23R 3/42; F23R 3/50; F23R 3/52; F23R 3/60
See application file for complete search history.

(56) References Cited

U.S. PATENT DOCUMENTS 6,832,484 B2 * 12/2004 Hofmann ..... F23M 5/02 60/752
8,683,806 B2 * 4/2014 Commaret ..... F23R 3/002 60/752

(Continued)

FOREIGN PATENT DOCUMENTS

EP 1022437 A1 7/2000
EP 1591724 A1 * 11/2005 ..... F23R 3/007

(Continued)

OTHER PUBLICATIONS

Extended European Search Report dated Feb. 11, 2020, issued during the prosecution of European Patent Application No. EP19205147.2.

*Primary Examiner* — Todd E Manahan
*Assistant Examiner* — Sean V Meiller
(74) *Attorney, Agent, or Firm* — Locke Lord LLP; Joshua L. Jones; Scott D. Wofsy

(57) ABSTRACT

A tile for a combustor dome of a gas turbine engine includes a tile body defining an upstream surface and an axially opposed downstream surface with at least one injection orifice defined through the tile body from the upstream surface to the downstream surface. The tile body extends in a radial direction from a radially inner surface to a radially outer surface. The radially inner and outer surfaces define circular arcs that are concentric with one another. The tile body extends circumferentially from a first end face to a second end face. The first end face follows a sigmoid profile and the second end face follows a sigmoid profile configured (Continued)

to interlock with the sigmoid profile of the first end face of another identical tile body.

20 Claims, 4 Drawing Sheets

(56) References Cited

U.S. PATENT DOCUMENTS

| | | | | |
|---|---|---|---|---|
| 8,984,896 | B2 * | 3/2015 | Davenport | F23R 3/002 60/752 |
| 9,644,844 | B2 * | 5/2017 | Prociw | F02C 7/222 |
| 10,408,451 | B2 * | 9/2019 | Larson | F23R 3/002 |
| 2015/0052901 | A1 | 2/2015 | Davenport et al. | |
| 2016/0377292 | A1 * | 12/2016 | Prociw | F23R 3/50 60/753 |
| 2018/0031238 | A1 * | 2/2018 | Harding | F23R 3/002 |
| 2018/0283692 | A1 * | 10/2018 | Ryon | F23R 3/10 |
| 2018/0371930 | A1 * | 12/2018 | Sippel | F01D 25/246 |
| 2019/0153886 | A1 * | 5/2019 | Vetters | F01D 25/005 |
| 2019/0383393 | A1 * | 12/2019 | Sarawate | F01D 11/005 |

FOREIGN PATENT DOCUMENTS

| | | | | |
|---|---|---|---|---|
| EP | 2589877 | A2 | 5/2013 | |
| EP | 3109557 | A2 | 12/2016 | |
| EP | 3321587 | A1 | 5/2018 | |
| EP | 3382280 | A1 | 10/2018 | |
| GB | 2524265 | A | 9/2015 | |
| WO | WO-2017025284 | A1 * | 2/2017 | F23R 3/002 |

* cited by examiner

COMBUSTOR DOME TILES

BACKGROUND OF THE INVENTION

1. Field of the Invention

The present disclosure relates to combustion, and more particularly to multipoint injection systems such as used for combustion in gas turbine engines.

2. Description of Related Art

Multipoint fuel injection systems would benefit from simple, low cost fuel injectors, manifolds, and dome construction to permit a large number of injectors to be used. Traditional fuel injector and nozzle designs require complex manifolding that can impede air flow from a compressor to the combustor in a gas turbine engine. Combustor dome designs and fuel injection systems can be expected to become more integrated with one another as the drive for ever greater engine pressure ratios, fuel efficiency, and reduced emissions continues.

Such conventional methods and systems have generally been considered satisfactory for their intended purpose. However, there is still a need in the art for improved multipoint combustion systems. The present disclosure provides a solution for this need.

SUMMARY OF THE INVENTION

A tile for a combustor dome of a gas turbine engine includes a tile body defining an upstream surface and an axially opposed downstream surface with at least one injection orifice defined through the tile body from the upstream surface to the downstream surface. The tile body extends in a radial direction from a radially inner surface to a radially outer surface. The radially inner and outer surfaces define circular arcs that are concentric with one another. The tile body extends circumferentially from a first end face to a second end face. The first end face follows a sigmoid profile and the second end face follows a sigmoid profile configured to interlock with the sigmoid profile of the first end face of another identical tile body.

The tile body can include a ceramic matrix composite (CMC) material. Each of the first and second end faces of the tile body can define a pair of axially spaced apart channels, wherein each of the channels runs from the radially inner surface to the radially outer surface of the tile body. Each channel of at least one of the pairs of axially spaced apart channels can include a feather seal element seated therein for creating a gas seal between the tile body an identical adjacent tile body. The at least one injection orifice can include six injection orifices, and the first and second end faces can be separated by an angular separation configured so that fifteen identical tile bodies can be circumferentially linked to form a complete annular combustor dome.

A combustor dome includes a plurality of tiles as described above circumferentially linked to form a complete annular combustor dome wall. The first end face of each tile body follows a sigmoid profile and wherein the second end face follows a sigmoid profile interlocked with the sigmoid profile of the first end face of an adjacent tile body.

The plurality of tiles can be sealed end to end with each other against gas flow in an axial direction except through the injection orifices. The sigmoid profiles can radially trap the feather seal elements between each circumferentially adjacent pair of the tile bodies. There can be fifteen identical tile bodies circumferentially linked to form the complete annular combustor dome wall.

A multipoint injection system includes a manifold extending in a circumferential direction defining a plurality of flow passages each having a main portion defined through the manifold in the circumferential direction. A plurality of feed arms extend radially inward from the manifold. Feed arm portions of the flow passages extend through each of the feed arms. A plurality of injection nozzles are included, wherein each of the feed arm portions of the flow passages includes a respective outlet opening with a respective one of the injection nozzles in fluid communication with each of the outlets. A combustor dome as described above is mounted together with the manifold with the injection nozzles extending though the combustor dome. An outer combustor wall is mounted to the manifold. An inner combustor wall is included radially inward from the outer combustor wall, the inner combustor wall mounted to an inner ring supported from radially inward ends of the feed arms. The combustor dome, injection nozzles, inner combustor wall, and outer combustor wall form an enclosure in which a majority of air passing from a compressor side of the combustor dome must pass through the injection nozzles to reach a combustor space defined radially between the inner and outer combustor walls.

The manifold and the inner ring can each include bayonet flanges extending in an axial direction away from the first axial end of the manifold for interlocking the manifold with the combustor dome, the inner combustor wall, and the outer combustor wall.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
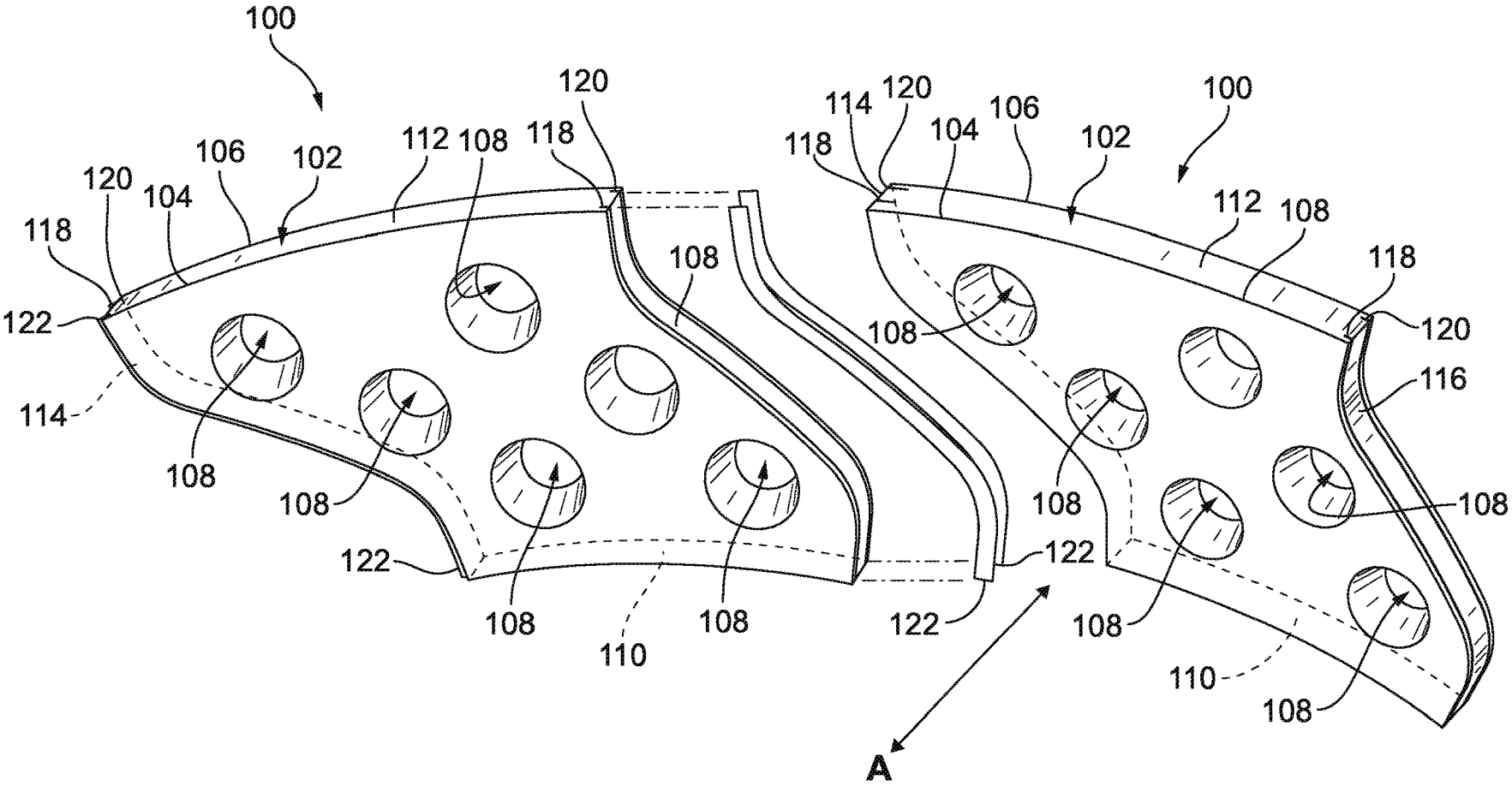
FIG. 1 is an exploded perspective view of an exemplary embodiment of an assembly of tiles for a combustor dome constructed in accordance with the present disclosure, showing two of the tiles separated with the feather seals for seating in the channels of the tiles.

Reference will now be made to the drawings wherein like reference numerals identify similar structural features or aspects of the subject disclosure. For purposes of explanation and illustration, and not limitation, a partial view of an exemplary embodiment of a tile for a combustor dome of a gas turbine engine in accordance with the disclosure is shown in FIG. 1 and is designated generally by reference character 100. Other embodiments of tiles in accordance with the disclosure, or aspects thereof, are provided in FIGS. 2-5, as will be described. The systems and methods described herein can be used to provide sealing against unwanted airflow between a compressor side and a combustor side of a combustor dome, e.g., in a gas turbine engine, and to facilitate assembly of a combustor dome into a combustion system of a gas turbine engine.

In FIG. 1, two tiles 100 are shown. Each tile 100 includes a tile body 102 defining an upstream 104 surface relative to the axis A, e.g., the upstream surface 104 is on the compressor side of the tile body 102, and an axially opposed downstream surface 106, e.g., on the combustor side. The tile body 102 can include a ceramic matrix composite (CMC) material, however metallic or other suitable materials can be used without departing from the scope of this disclosure. Each tile 100 has six injection orifices 108 defined through the tile body 102 from the upstream surface 104 to the downstream surface 106, however those skilled in the art will readily appreciate that any other suitable number of injection orifices can be used without departing from the scope of this disclosure.

The tile body 102 extends in a radial direction relative to the axis A from a radially inner surface 110 to a radially outer surface 112. The radially inner and outer surfaces 110, 112 define circular arcs that are concentric with one another, i.e., centered on the axis A. Each tile body 102 extends circumferentially from a first end face 114 to a second end face 116. The first end face 114 follows a sigmoid profile and the second end face 116 follows a sigmoid profile configured to interlock with the sigmoid profile of the first end face 114 of another identical adjacent tile body 102.

Figure 2:
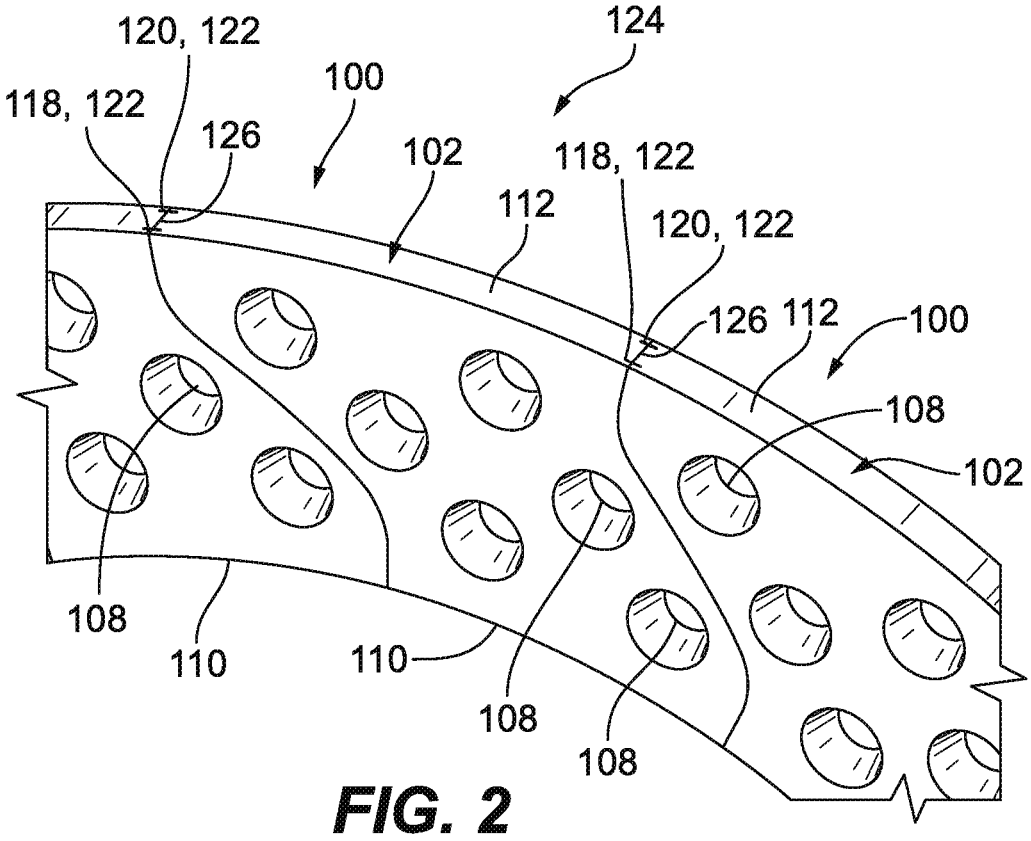
FIG. 2 is perspective view of the tiles of FIG. 1, showing the tiles and feather seals assembled together.

Each of the first and second end faces 114, 116 of each tile body 102 defines a pair of axially spaced apart channels 118, 120, wherein each of the channels 118, 120 runs from the radially inner surface 110 to the radially outer surface 112 of the tile body 102. When assembled into a combustor dome 124 as shown in FIG. 2, each channel 118, 120 includes a feather seal element 122 seated therein for creating a gas seal between the tile body 102 an identical, adjacent tile body 102. The feather seal elements 122 can be metallic or ceramic matrix composite material.

Figure 3:
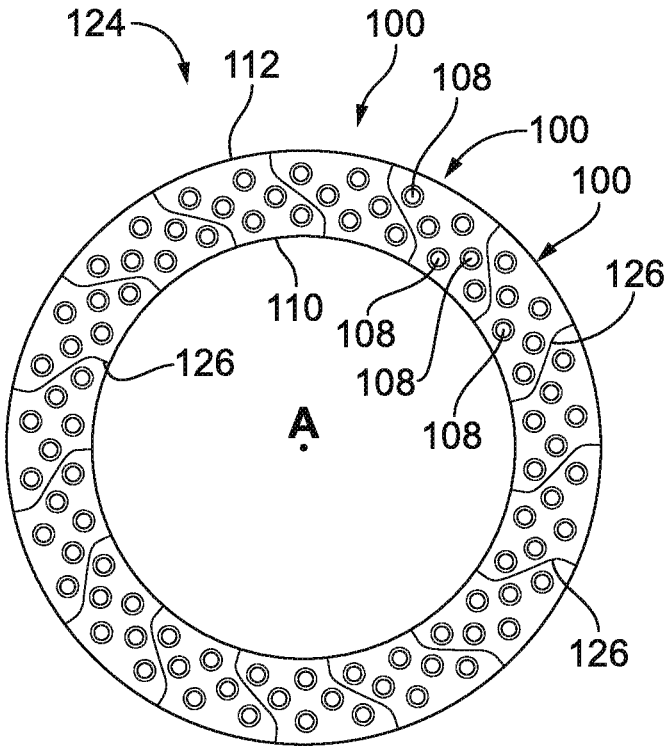
FIG. 3 is an end view from the compressor side of the combustor dome of FIG. 2, showing all of the tiles assembled into the combustor dome.

The first and second end faces 114, 116 are separated by an angular separation configured so that fifteen identical tile bodies 102 can be circumferentially linked to form a wall of a complete annular combustor dome 124 as shown in FIG. 3, wherein the sigmoid profile of first end face 114 (labeled in FIG. 1) of each tile body 102 is interlocked with the sigmoid profile of the second end face 116 (labeled in FIG. 1) of an adjacent tile body 102. Those skilled in the art will readily appreciate that any suitable number of tiles can be used to form a combustor dome without departing from the scope of this disclosure. The plurality of tiles 102 are sealed end to end circumferentially with each other against gas flow in an axial direction, e.g., in the direction of axis A of FIG. 1, except through the injection orifices 108. The sigmoid profiles of the assembled first and second end faces 114, 116 radially trap the feather seal elements 122 between each circumferentially adjacent pair of the tile bodies 102.

The seams 126, labeled in FIG. 2, wherein the first and second end faces 114, 116 are assembled together also form stress relievers at regular intervals around the combustor dome 124 to reduce stress fractures, e.g., from thermally induced stresses of metallic manifold, feed arm, and injector components that are relatively cold being assembled together with hot CMC components, in undesirable places in the combustor dome 124, e.g. places where the air seal between the compressor side and the combustor side of the combustor dome 124 would be broken. The seams 126 also provide mechanical accommodation to facilitate assembly of the combustor dome 124. Using two feather seal elements 122 at each seam 126 allows one feather seal element 122 to stop axial flow through the seam 126 and the second feather seal element 122 to stop radial leakage due to the radial thickness of the tiles 100.

Figure 4:
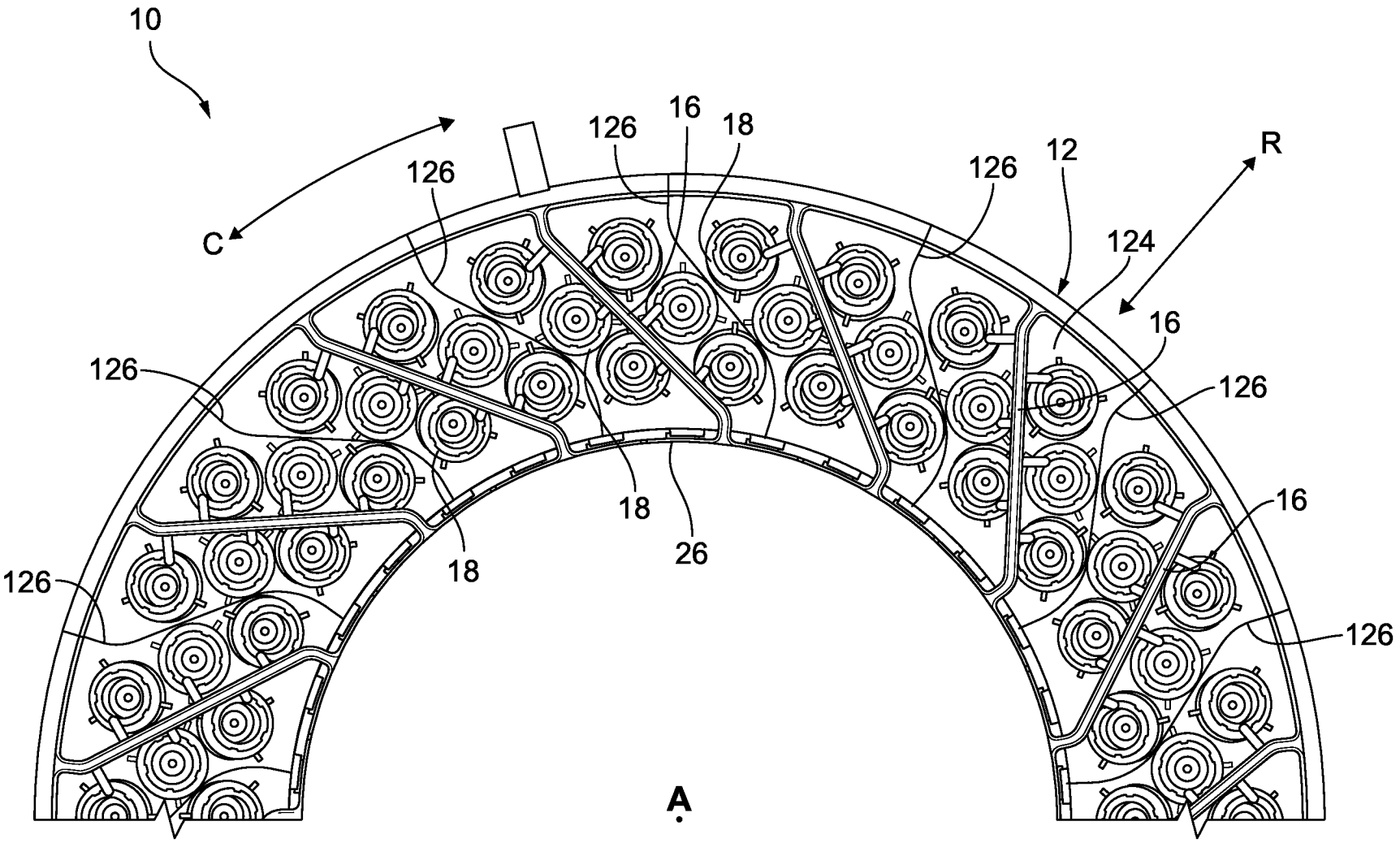
FIG. 4 is an end view from the compressor side of a portion of the combustor dome of FIG. 3, showing the fuel manifold and injection nozzles assembled onto the combustor dome as a system.
Figure 5:
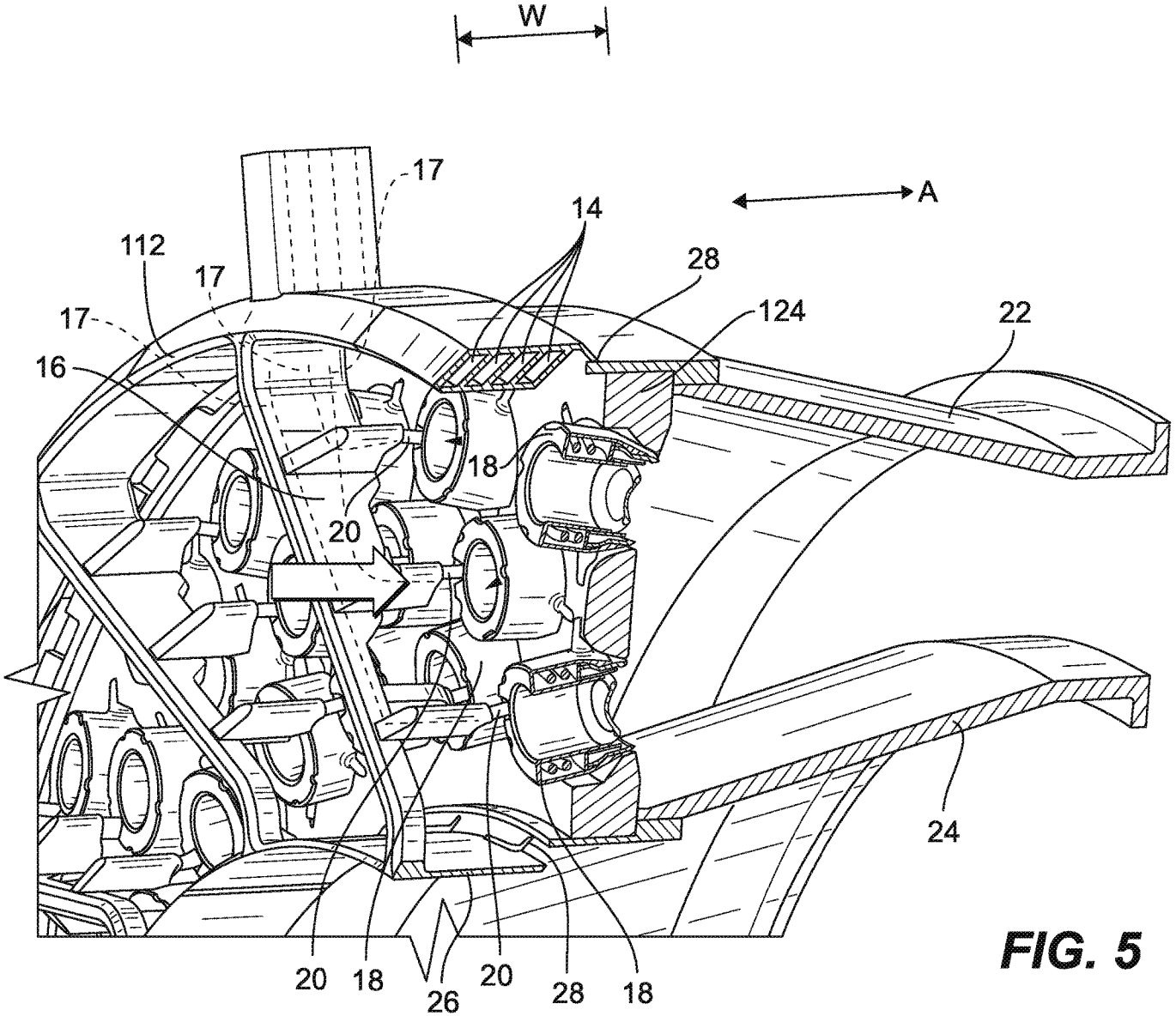
FIG. 5 is a cut away perspective view of a portion of a portion of the system of FIG. 4, showing the inner and outer combustor walls.

With reference now to FIG. 4, a multipoint injection system 10 includes a manifold 12 extending in a circumferential direction C defining a plurality of flow passages 14 each having a main portion defined through the manifold in the circumferential direction, as shown in FIG. 5. A plurality of feed arms 16 extend radially inward from the manifold 12. Feed arm portions 17 of the flow passages 14 extend through each of the feed arms 16. A plurality of injection nozzles 18 are included, wherein each of the feed arm portions 17 of the flow passages 14 includes a respective outlet 20 opening with a respective one of the injection nozzles 18 in fluid communication with each of the outlets 20. A combustor dome 124 as described above is mounted together with the manifold 12 with the injection nozzles 18 extending though the injection orifices 108 of the combustor dome 124. Each feed arm 16 supports six injection nozzles 18, which pass through the respective six injection orifices 108 of a single tile 100. It is also contemplated that the feed arms 16 could straddle the seams 126 between the tiles 100, e.g. with three injection nozzles 18 of a feed arm 16 passing through one tile 100 and three injection nozzles 18 of the same feed arm 16 passing through a second, adjacent one of the tiles 100.

Referring now to FIG. 5, an outer combustor wall 22 is mounted to the manifold 12. An inner combustor wall 24 is included radially inward from the outer combustor wall 12. The inner combustor wall 24 is mounted to an inner ring 26 supported from radially inward ends of the feed arms 16. The combustor dome 124, injection nozzles 18, inner combustor wall 24, and outer combustor wall 22 form an enclosure in which a majority of air passing from a compressor side, e.g. the left side as viewed in FIG. 5, of the combustor dome 124 must pass through the injection nozzles 18 to reach a combustor space defined radially between the inner and outer combustor walls 22, 24.

The manifold 12 and the inner ring 26 each include bayonet flanges 28 extending in an axial direction away from the first axial end of the manifold 12 for interlocking the manifold 12 with the combustor dome 124, the inner combustor wall 24, and the outer combustor wall 22.

Systems and methods as disclosed herein provide potential advantages over traditional systems and methods as follows. Fuel tubes and segmented tile construction as disclosed herein provide adaptability in the combustor. Feather seals conforming to segmented tile shapes allow adjustment of tile interfaces while sealing potential leakages through a combustor dome. Adjustable tiles allow for integration of cold, metallic fuel system components together with hot ceramic combustor dome components.

The methods and systems of the present disclosure, as described above and shown in the drawings, provide for combustor domes with superior properties relative to traditional systems including improved sealing against unwanted airflow between a compressor side and a combustor side of a combustor dome, e.g., in a gas turbine engine, and facilitated assembly of a combustor dome into a combustion system of a gas turbine engine. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A the for a combustor dome of a gas turbine engine comprising: a tile body defining an upstream surface and an axially opposed downstream surface with at least one injection orifice defined through the tile body from the upstream surface to the downstream surface, wherein the tile body extends in a radial direction from a radially inner surface to a radially outer surface, wherein the radially inner and outer surfaces define circular arcs that are concentric with one another, wherein the tile body extends circumferentially from a first end face to a second end face, wherein the first end face follows a sigmoid profile, wherein the second end face follows a sigmoid profile configured to interlock with the sigmoid profile of the first end face of another identical the body at a seam, wherein a plurality of feed arms extend radially inward from a manifold radially outboard of the tile bodies to an inner ring radially inboard of the tiles, wherein each of the feed arms include a plurality of nozzles, wherein the feed arms follow a sigmoid profile circumferentially offset from the seam between the bodies.

2. The tile as recited in claim 1, wherein the tile body includes a ceramic matrix composite (CMC) material.

3. The tile as recited in claim 1, wherein each of the first and second end faces of the tile body defines a pair of axially spaced apart channels, wherein each of the channels runs from the radially inner surface to the radially outer surface of the tile body.

4. The tile as recited in claim 3, wherein each channel of at least one of the pairs of axially spaced apart channels includes a feather seal element seated therein for creating a gas seal between the tile body an identical adjacent tile body.

5. The tile as recited in claim 1, wherein the at least one injection orifice includes six injection orifices, and wherein the first and second end faces are separated by an angular separation configured so that fifteen identical tile bodies can be circumferentially linked to form a complete annular combustor dome.

6. A combustor dome comprising: a plurality of tiles circumferentially linked to form a complete annular combustor dome wall, wherein each of the tiles includes: a tile body defining an upstream surface and an axially opposed downstream surface with at least one injection orifice defined through the tile body from the upstream surface to the downstream surface, wherein the tile body extends in a radial direction from a radially inner surface to a radially outer surface, wherein the radially inner and outer surfaces define circular arcs that are concentric with one another, and wherein the tile body extends circumferentially from a first end face to a second end face, wherein the first end face follows a sigmoid profile, wherein the second end face follows a sigmoid profile interlocked with the sigmoid profile of the first end face of an adjacent tile body at a seam; and a plurality of feed arms extending radially inward from the manifold radially outboard of the file bodies to an inner ring radially inboard of the tiles, wherein each of the feed arms include a plurality of nozzles, wherein the feed arms follow a sigmoid profile circumferentially offset from the seam between each of the plurality of tiles.

7. The combustor dome as recited in claim 6, wherein the plurality of tiles are sealed end to end with each other against gas flow in an axial direction except through the injection orifices.

8. The combustor dome as recited in claim 6, wherein each tile body includes a ceramic matrix composite (CMC) material.

9. The combustor dome as recited in claim 6, wherein each of the first and second end faces of each tile body defines a pair of axially spaced apart channels, wherein each of the channels runs from the radially inner surface to the radially outer surface of the tile body.

10. The combustor dome as recited in claim 9, wherein each channel of at least one of the pairs of axially spaced apart channels includes a feather seal element seated therein for creating a gas seal between each tile body and an adjacent tile body.

11. The combustor dome as recited in claim 10, wherein the sigmoid profiles radially trap the feather seal elements between each circumferentially adjacent pair of the tile bodies.

12. The combustor dome as recited in claim 6, wherein the at least one injection orifice includes six injection orifices in each tile body, and wherein there are fifteen identical tile bodies circumferentially linked to form the complete annular combustor dome wall.

13. A multipoint injection system comprising: a manifold extending in a circumferential direction defining a plurality of flow passages each having a main portion defined through the manifold in the circumferential direction; a plurality of feed arms extending radially inward from the manifold, wherein feed arm portions of the flow passages extend through each of the feed arms; a plurality of injection nozzles, wherein each of the feed arm portions of the flow passages includes a respective outlet opening With a respective one of the injection nozzles in fluid communication with each of the outlets; a combustor dome mounted together with the manifold with the injection nozzles extending though the combustor dome, wherein the combustor dome includes: a plurality of tiles circumferentially linked to form a complete annular combustor dome wall, wherein each of the tiles includes: a tile body defining an upstream surface and an axially opposed downstream surface with at least one injection orifice defined through the tile body from the upstream surface to the downstream surface, wherein the tile body extends in a radial direction from a radially inner surface to a radially outer surface, wherein the radially inner and outer surfaces define circular arcs that are concentric with one another, and wherein the tile body extends circumferentially from a first end face to a second end face, wherein the first end face follows a sigmoid profile, wherein the second end face follows a sigmoid profile interlocked with the sigmoid profile of the first end face of an adjacent the body, at a seam; an outer combustor wall mounted to the manifold; and an inner combustor wall radially inward from the outer combustor wall, the inner combustor wall mounted to an inner ring supported from radially inward ends of the feed arms, wherein the combustor dome, injection nozzles, inner combustor wall, and outer combustor wall form an enclosure in which a majority of aft passing from a compressor side of the combustor dome must pass through the injection nozzles to reach a combustor space defined radially between the inner and outer combustor walls, wherein the plurality of feed arms extend radially inward from the manifold radially outboard of the tile bodies to an inner ring radially inboard of the tiles, wherein each of the feed arms include a plurality of nozzles, wherein the feed arms follow a sigmoid profile circumferentially offset from the seam between each of the plurality of tiles.

14. The system as recited in claim 13, wherein the manifold and the inner ring each include bayonet flanges extending in an axial direction away from the first axial end of the manifold for interlocking the manifold with the combustor dome, the inner combustor wall, and the outer combustor wall.

15. The system as recited in claim 13, wherein the plurality of tiles are sealed end to end with each other against gas flow in an axial direction except through the injection orifices.

16. The system as recited in claim 13, wherein each tile body includes a ceramic matrix composite (CMC) material.

17. The system as recited in claim 13, wherein each of the first and second end faces of each tile body defines a pair of axially spaced apart channels, wherein each of the channels runs from the radially inner surface to the radially outer surface of the tile body.

18. The system as recited in claim 17, wherein each channel of at least one of the pairs of axially spaced apart channels includes a feather seal element seated therein for creating a gas seal between each tile body and an adjacent tile body.

19. The system as recited in claim 18, wherein the sigmoid profiles radially trap the feather seal elements between each circumferentially adjacent pair of the tile bodies.

20. The system as recited in claim 13, wherein the at least one injection orifice includes six injection orifices in each tile body, and wherein there are fifteen identical tile bodies circumferentially linked to form the complete annular combustor dome wall.

* * * * *